US011174558B2

(12) United States Patent
Taya et al.

(10) Patent No.: US 11,174,558 B2
(45) Date of Patent: Nov. 16, 2021

(54) LIQUID REMOVAL DEVICE AND LIQUID REMOVAL METHOD

(71) Applicant: NIPPON STEEL & SUMITOMO METAL CORPORATION, Tokyo (JP)

(72) Inventors: Takao Taya, Tokyo (JP); Hiroyuki Kato, Tokyo (JP); Takanori Kiyosue, Tokyo (JP); Yoshihiro Yamada, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 47 days.

(21) Appl. No.: 16/067,371

(22) PCT Filed: Mar. 29, 2017

(86) PCT No.: PCT/JP2017/012951
§ 371 (c)(1),
(2) Date: Jun. 29, 2018

(87) PCT Pub. No.: WO2017/170714
PCT Pub. Date: Oct. 5, 2017

(65) Prior Publication Data

US 2018/0327914 A1 Nov. 15, 2018

(30) Foreign Application Priority Data

Mar. 29, 2016 (JP) ..... JP2016-066122

(51) Int. Cl.
*C23G 3/02* (2006.01)
*C23G 1/08* (2006.01)
*B21B 45/02* (2006.01)

(52) U.S. Cl.
CPC ..... *C23G 3/029* (2013.01); *C23G 1/08* (2013.01); *C23G 3/023* (2013.01); *C23G 3/026* (2013.01); *B21B 45/0278* (2013.01)

(58) Field of Classification Search
CPC ..... C23G 3/029; C23G 1/08; C23G 3/023; C23G 3/026; B21B 45/0278
(Continued)

(56) References Cited

U.S. PATENT DOCUMENTS 3,747,481 A * 7/1973 Tonking, Jr. ..... B31F 1/28 493/381
5,070,628 A * 12/1991 Zagar ..... B05C 11/06 34/644
(Continued)

FOREIGN PATENT DOCUMENTS

CN 1267904 A 9/2000
EP 0328227 A2 * 8/1989 ..... F26B 13/104
(Continued)

OTHER PUBLICATIONS

Chinese Office Action and Search Report for Chinese Application No. 201780013254.3, dated Oct. 12, 2019, with a partial English translation.
(Continued)

*Primary Examiner* — Jessica Yuen
(74) *Attorney, Agent, or Firm* — Birch, Stewart, Kolasch & Birch, LLP

(57) ABSTRACT

There is provided a liquid removal device that removes liquid attached to a surface of a steel sheet, the device including a slit nozzle that jets gas to the surface of the sheet, the slit nozzle being installed so as to jet gas from a downstream side toward an upstream side in a movement direction of the sheet that moves relatively to the slit nozzle and being configured in a manner that a jet angle θ, a back face inclination angle β, and a back face length L of a nozzle back face of the slit nozzle satisfy, β+θ≥60° and L≥20mm, and a gap h between a jetting port of the slit nozzle and the sheet, a slit width d, and nozzle pressure $P_n$ of the slit nozzle
(Continued)

satisfy the following relationship: $P_n \geq 2.0 \times 10^{10} (h/d)^{0.6} \{1/(1+\exp(\beta+\theta-58)+1\}^{-4} L^{-7}$.

13 Claims, 10 Drawing Sheets

(58) Field of Classification Search
USPC ..... 34/631, 644
See application file for complete search history.

(56) References Cited

U.S. PATENT DOCUMENTS

| | | | | |
|---|---|---|---|---|
| 5,313,685 | A | 5/1994 | Kramer et al. | |
| 7,268,323 | B2 * | 9/2007 | Tomobe | B29C 71/02 219/388 |
| 7,697,126 | B2 * | 4/2010 | Farsaie | G01C 15/002 356/141.5 |
| 2003/0074805 | A1 * | 4/2003 | Aydore | F26B 13/10 34/444 |

FOREIGN PATENT DOCUMENTS

| | | | |
|---|---|---|---|
| JP | 56-12316 | B2 | 3/1981 |
| JP | 6-65766 | A | 3/1994 |
| JP | 6-336667 | A | 12/1994 |
| JP | 10-211514 | A | 8/1998 |
| JP | 2002-294478 | A | 10/2002 |
| JP | 2008-23561 | A | 2/2008 |
| WO | WO 2012/172648 | A1 | 12/2012 |

OTHER PUBLICATIONS

Indian Office Action for Indian Application No. 201817024098, dated Oct. 16, 2019, with a partial English translation.
Extended European Search Report for corresponding European Application No. 17775248.2, dated Nov. 22, 2019.
Canadian Office Action dated Jun. 25, 2019, for corresponding Canadian Patent Application No. 3,009,318.
Written Opinion of the International Searching Authority dated May 9, 2017, issued in PCT/JP2017/012951 (Form PCT/ISA/237).
International Search Report for PCT/JP2017/012951 dated May 9, 2017.
Written Opinion of the International Searching Authority for PCT/JP2017/012951 (PCT/ISA/237) dated May 9, 2017.
Korean Office Action (Notification of Reason for Refusal) for corresponding Korean Patent Application No. 10-2018-7023431, dated Feb. 18, 2020.

* cited by examiner

LIQUID REMOVAL DEVICE AND LIQUID REMOVAL METHOD

TECHNICAL FIELD

The present invention relates to a liquid removal device that removes liquid attached to the surface of a sheet-like member, and a liquid removal method using this.

BACKGROUND ART

On the surface of a steel sheet after hot rolling, an oxide film called scale is formed. Since scale causes a flaw or the like of the steel sheet, pickling with hydrochloric acid, sulfuric acid, or the like is performed on the steel sheet as necessary. In a conventional continuous pickling line, a steel sheet in a coil form is uncoiled by an uncoiler and subjected to leveling by a leveler, a rear end of a preceding steel sheet and a front end of a following steel sheet are welded to provide a continuous steel sheet, and then the steel sheet is passed through a pickling bath to have scale on its surface removed by dissolution. The steel sheet from which scale has been removed in the pickling bath has acid or water attached to its surface removed in a washing bath, is dried by a drier, and then is coiled into a coil form again.

Here, conventionally, in order to remove acid, water, or the like attached to a steel sheet, a pair of wringer rolls that is installed in a washing bath and removes liquid on the steel sheet being passed, and a drier that blows off, with hot air, liquid remaining on the surface of the steel sheet that has passed through the wringer rolls to promote drying have been used. The wringer roll, whose surface is made of a soft rubber layer, squeezes out liquid attached to the steel sheet surface by being pressed against the steel sheet.

At this time, if a gap occurs between the wringer rolls and both ends of the steel sheet, liquid builds up in the gap, and liquid remains in a strip form on surfaces of the both ends of the steel sheet that has passed through the wringer rolls. In addition, if the wringer rolls are used for a long period of time, portions corresponding to the both ends of the steel sheet are worn to cause a space in which the wringer rolls do not come into contact with the steel sheet, which broadens a range in which liquid remains on the steel sheet surface. If liquid thus remains on the surface of the steel sheet that has passed through the wringer rolls, the liquid cannot be sufficiently blown off by the drier.

Hence, a technology of installing a liquid draining device between wringer rolls and a drier and removing liquid remaining after passing through the wringer rolls has been proposed. For example, Patent Literature 1 discloses a liquid removal method including a pair of liquid draining rolls that removes, with a press, liquid attached to upper and lower surfaces of a steel strip, and a nozzle that jets gas to a gap formed between the liquid draining rolls and an end of the steel strip, at a predetermined flow velocity, from the center of the steel strip toward the end of the steel strip.

CITATION LIST

Patent Literature

Patent Literature 1: JP H6-65766A

SUMMARY OF INVENTION

Technical Problem

However, there has been a problem in that even if the liquid removal method described in Patent Literature 1 is used, both the wringer rolls and the drier need to be provided, which increases cost for maintaining equipment.

Hence, in view of the above problem, an object of the present invention is to provide a novel and improved liquid removal device and a liquid removal method using this, which are capable of removing liquid on a steel sheet without using wringer rolls and a drier.

Solution to Problem

According to an aspect of the present invention in order to achieve the above-mentioned object, there is provided a liquid removal device that removes liquid attached to a surface of a sheet-like member that is conveyed, the liquid removal device including: a slit nozzle that jets gas to the surface of the sheet-like member; and a gap measurement device that measures a gap between a jetting port of the slit nozzle and the sheet-like member. The slit nozzle is installed so as to jet gas from a downstream side toward an upstream side in a movement direction of the sheet-like member that moves relatively to the slit nozzle. The slit nozzle satisfies the following relational formulas:

$$P_n \geq 2.0 \times 10^{10} (h/d)^{0.6} \left( \frac{1}{1 + \exp(\beta + \theta - 58)} + 1 \right)^4 L^{-7}, \quad \beta + \theta \geq 60°,\ L \geq 20\ \text{mm}, \qquad \text{[Math. 1]}$$

where gas pressure inside the slit nozzle is defined as nozzle pressure $P_n$ [KPa], an angle formed by a direction perpendicular to the surface of the sheet-like member and a jet direction of the gas is defined as a jet angle θ [°], an angled formed by the jet direction of the gas and a nozzle back face that is a face disposed from the jetting port of the slit nozzle toward the downstream side in the movement direction is defined as a back face inclination angle β [°], a length of the nozzle back face in the movement direction is defined as L [mm], the gap is defined as h [mm], and a slit width of the slit nozzle is defined as d [mm].

The liquid removal device may further include a gap adjustment mechanism that adjusts the gap on the basis of a measurement result of the gap measurement device. The gap adjustment mechanism may adjust the gap to 20 mm or less.

The gap adjustment mechanism may adjust the gap by changing a position of the slit nozzle.

Alternatively, when the sheet-like member is moved in the movement direction by a table roll that conveys the sheet-like member, the gap adjustment mechanism may adjust the gap by changing a position of the table roll on which the sheet-like member is placed.

The gap measurement device may measure the gap at each of measurement positions near both ends of the jetting port of the slit nozzle in a longitudinal direction. The gap adjustment mechanism may adjust the gap at each of the measurement positions to 20 mm or less.

The gap measurement device may measure the gap by a laser rangefinder, for example.

The slit nozzle may be fixed, and the sheet-like member may move relatively to the slit nozzle by being moved in the movement direction by a conveyor device.

The conveyor device may be a table roll on which the sheet-like member is placed.

Alternatively, the conveyor device may be a coiling/uncoiling device including a pay-off reel that uncoils the sheet-like member wound in a coil form, and a tension reel that coils, into a coil form, the sheet-like member from which the liquid has been removed.

In addition, the sheet-like member may be stationary, and the slit nozzle may be moved relatively to the sheet-like member by a nozzle movement mechanism.

The slit nozzle of the liquid removal device may include a nozzle main body including the jetting port, and a gas flow channel that guides, to the jetting port, the gas that is externally supplied, and a back face member having the nozzle back face provided to extend from the jetting port of the nozzle main body toward the downstream side in the movement direction of the sheet-like member. At this time, the nozzle back face may be a counter face of the back face member that faces the surface of the sheet-like member.

In addition, according to another aspect of the present invention, there is provided a liquid removal method that removes liquid attached to the surface of the sheet-like member by using the above liquid removal device, the liquid removal method including: a measurement step of measuring, by the gap measurement device, a gap between the jetting port of the slit nozzle and the sheet-like member; a gap adjustment step of adjusting the gap to 20 mm or less by changing a position of at least one of the slit nozzle and the sheet-like member on the basis of the measured gap; and a liquid removal step of removing the liquid attached to the surface of the sheet-like member by jetting gas from the slit nozzle to the surface of the sheet-like member while relatively moving the slit nozzle and the sheet-like member.

The gap may be readjusted by executing the measurement step and the gap adjustment step each time a sheet thickness of the sheet-like member changes.

Advantageous Effects of Invention

As described above, according to the present invention, liquid on a steel sheet can be removed without using wringer rolls and a drier.

DESCRIPTION OF EMBODIMENTS

Figure 1:
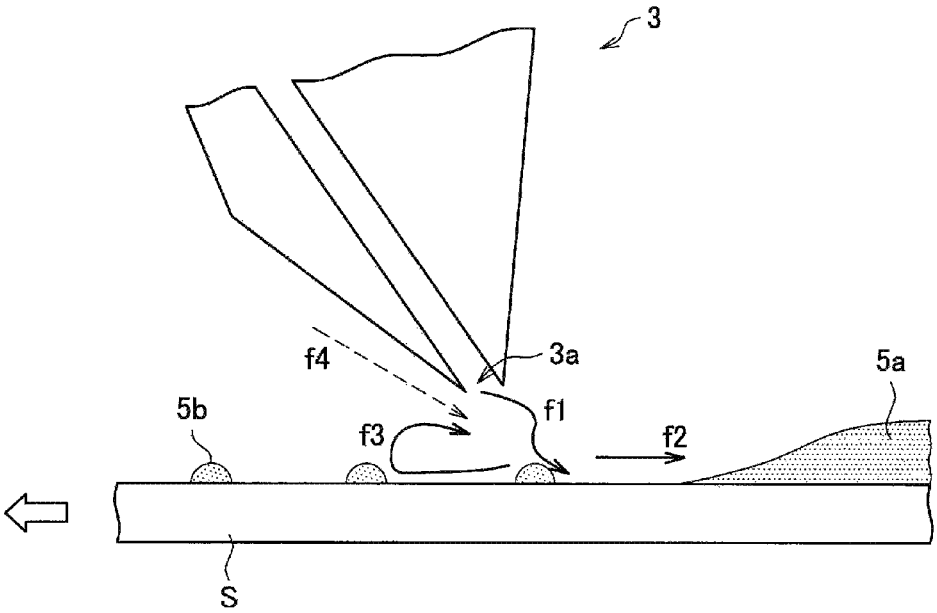
FIG. 1 is an explanatory diagram illustrating a situation of liquid draining by a liquid removal device using a common slit nozzle.

Hereinafter, (a) preferred embodiment(s) of the present invention will be described in detail with reference to the appended drawings. Note that, in this specification and the appended drawings, structural elements that have substantially the same function and structure are denoted with the same reference numerals, and repeated explanation of these structural elements is omitted.

<1. Overview>

Figure 2:
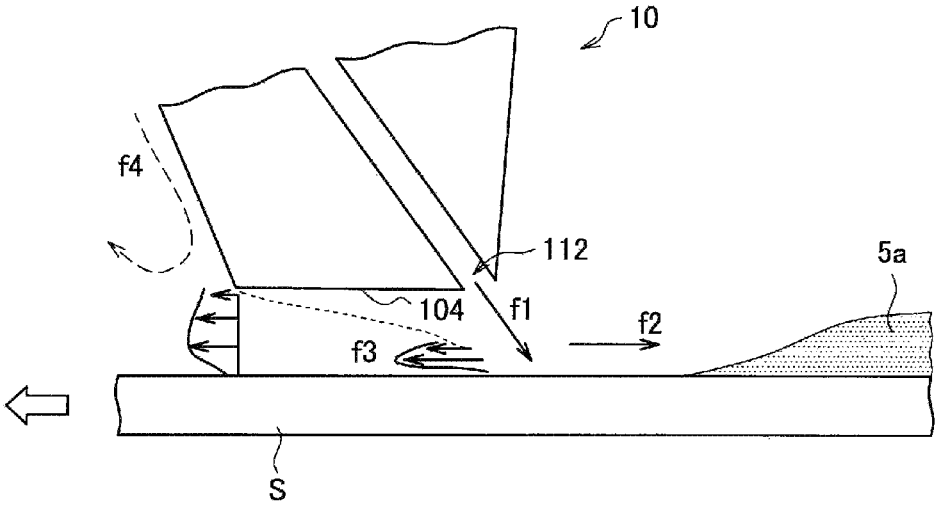
FIG. 2 is an explanatory diagram illustrating a situation of liquid draining by a liquid removal device using a slit nozzle according to an embodiment of the present invention.

First, a schematic configuration of a liquid removal device according to an embodiment of the present invention is described on the basis of FIGS. 1 and 2. FIG. 1 is an explanatory diagram illustrating a situation of liquid draining by a liquid removal device using a common slit nozzle 3. FIG. 2 is an explanatory diagram illustrating a situation of liquid draining by a liquid removal device using a slit nozzle 10 according to an embodiment of the present invention.

In the liquid removal device according to the present embodiment, a slit nozzle jets air to the surface of a steel sheet, which is a sheet-like member, to remove liquid on the steel sheet surface. As a liquid removal device using a common slit nozzle, an air blowing device that jets air from a jetting port 3*a* of the slit nozzle 3 to a steel sheet surface from a downstream side in a movement direction of the steel sheet that moves relatively to the liquid removal device, as illustrated in FIG. 1, is used. As illustrated in FIG. 1, a fast gas jet flow f1 jetted from the slit nozzle 3 collides with the surface of a steel sheet S, and pushes back a liquid 5*a* on the steel sheet S by a flow f2 toward an upstream side in the movement direction, thereby removing the liquid 5*a* on the steel sheet S.

On the other hand, when the gas jet flow f1 collides with the surface of the steel sheet S, a reverse flow f3 toward the downstream side in the movement direction also occurs. This reverse flow f3 interferes with an outside air suction flow f4 that is caused when the air blowing device sucks outside air and flows to the surface of the steel sheet S along a back face of the slit nozzle 3, so that the gas jet flow f1 is temporarily disturbed. Consequently, collision pressure when the gas jet flow f1 collides with the surface of the steel sheet S decreases, and pressure of the flow f2 toward the upstream side in the movement direction also decreases; thus, the liquid 5*a* on the steel sheet S cannot be sufficiently removed, and a liquid 5*b* remains on the steel sheet S even on the downstream side in the movement direction with respect to the slit nozzle 3.

Hence, the present inventors studied a configuration of a liquid removal device that can suppress a decrease in collision pressure of the gas jet flow f1 due to interference between the outside air suction flow f4 and the reverse flow f3 after collision with the surface of the steel sheet S. Consequently, it was found that, as illustrated in FIG. 2, when a nozzle back face 104, which is a face on the downstream side in the movement direction of the steel sheet S, is provided to extend along the surface of the steel sheet S to the downstream side in the movement direction farther than in the slit nozzle 3 illustrated in FIG. 1, the influence of the outside air suction flow f4 due to the Coanda effect can be suppressed, and disturbance in the gas jet flow f1 can be suppressed. The liquid removal device according to the present embodiment is described in detail below.

<2. Configuration of Liquid Removal Device>

(2-1. Overall Configuration)

Figure 3:
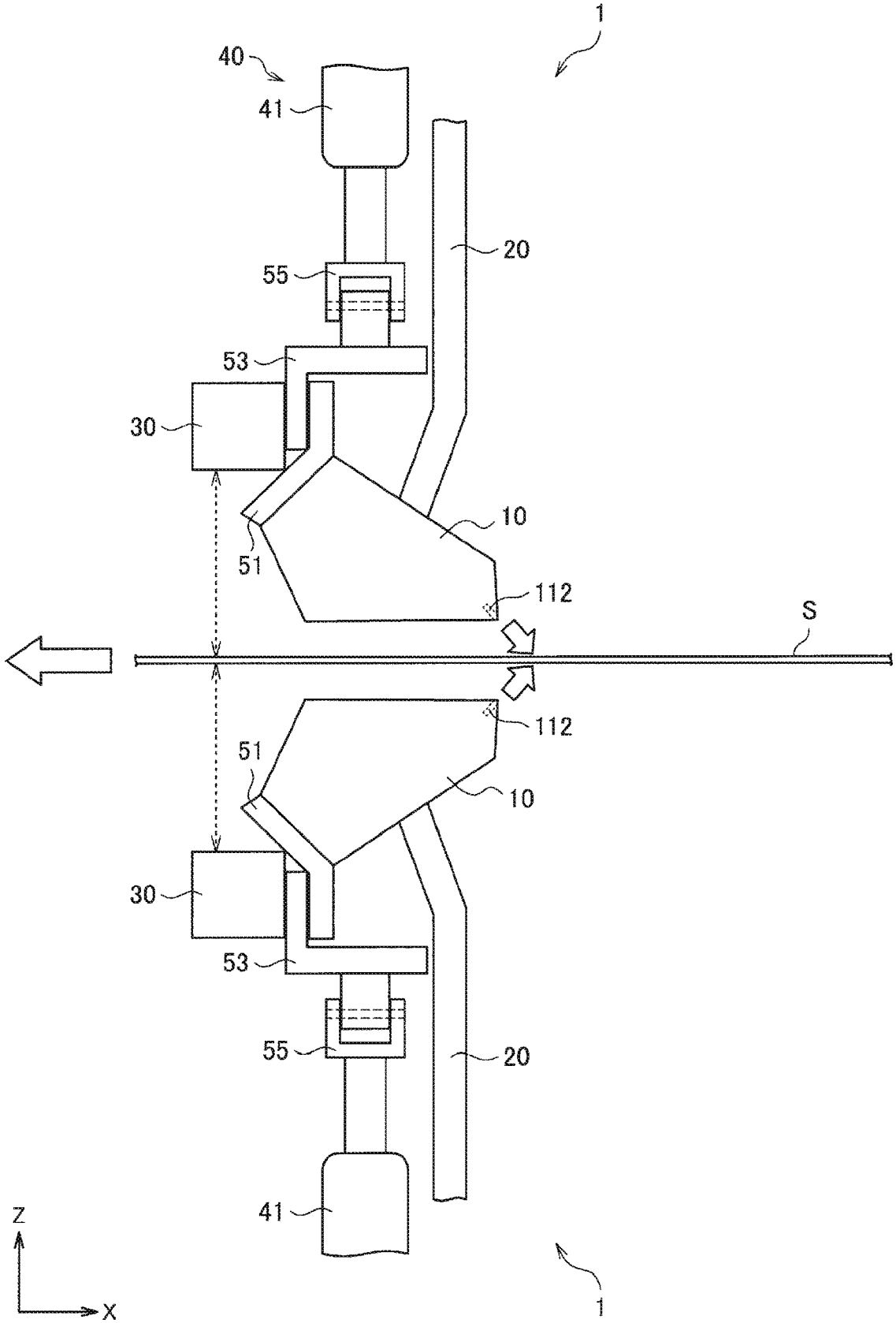
FIG. 3 is a side view of a configuration example of a liquid removal device according to the embodiment.
Figure 4:
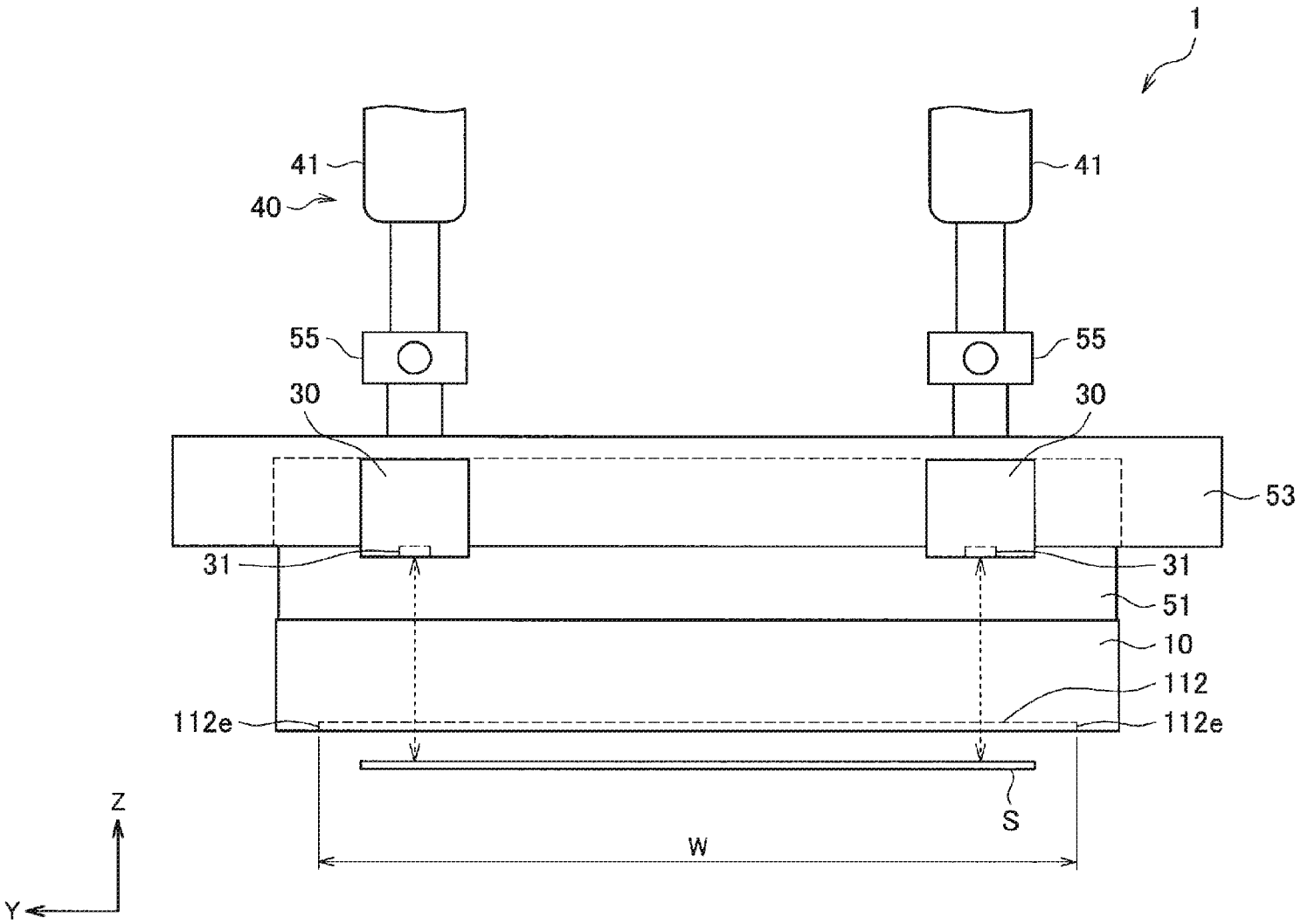
FIG. 4 is a back view of the liquid removal device illustrated in FIG. 3.

First, an overall configuration of a liquid removal device 1 according to the present embodiment is described on the basis of FIGS. 3 and 4. FIG. 3 is a side view of a configuration example of the liquid removal device 1 according to the present embodiment. FIG. 4 is a back view of the liquid removal device 1 illustrated in FIG. 3. In the present embodiment, a case where the liquid removal device 1 is fixed and used is described. That is, the slit nozzle 10 is fixed, and the steel sheet S conveyed by a conveyor device moves relatively to the slit nozzle 10.

The liquid removal device 1 according to the present embodiment is a device that removes liquid attached to the surface of the steel sheet S, which is an example of a sheet-like member, for example. The liquid removal device 1 is fixed, and the steel sheet S moves relatively to the liquid removal device 1 by being conveyed by the conveyor device. In the following description, the movement direction of the steel sheet S that moves relatively to the liquid removal device 1 is also referred to as a conveyance direction. As illustrated in FIG. 3, upper and lower liquid removal devices 1 are disposed to be symmetric with respect to the steel sheet S being conveyed by the conveyor device. The upper and lower liquid removal devices 1 may have the same configuration. The conveyor device that conveys the steel sheet S may be, for example, a table roll that moves the steel sheet S placed thereon by rotation. Alternatively, the conveyor device may be a coiling/uncoiling device including both end rolls provided at both ends across the liquid removal device 1 in the conveyance direction of the steel sheet S. The coiling/uncoiling device includes, as the both end rolls, a pay-off reel that uncoils the steel sheet S wound in a coil form, and a tension reel that coils, into a coil form, the steel sheet S from which liquid on the surface has been removed by the liquid removal device 1.

As illustrated in FIG. 3, the liquid removal device 1 according to the present embodiment includes the slit nozzle 10, a gap measurement device 30, and a gap adjustment mechanism 40.

The slit nozzle 10 jets gas (e.g., air) externally supplied via an air supply pipe 20 to the surface of the steel sheet S from a jetting port 112 at a nozzle tip. The slit nozzle 10 is disposed in a manner that a slit length direction of the jetting port 112 open in a slit form corresponds to a width direction of the steel sheet S. This enables liquid on the steel sheet S to be removed over the entire width of the steel sheet S. The jetting port 112 is directed to the surface of the steel sheet S so as to jet gas from the downstream side toward the upstream side in the conveyance direction of the steel sheet S (i.e., from a negative direction side toward a positive direction side of an X axis). In addition, as illustrated in FIG. 4, the slit nozzle 10 is supported by the gap adjustment mechanism 40 that brings the slit nozzle 10 close to or away from the steel sheet S, on both sides in the slit length direction (Y direction) of the jetting port 112 open in a slit form. The gap adjustment mechanism 40 moving the slit nozzle 10 vertically enables adjustment of a gap between the jetting port 112 and the surface of the steel sheet S.

As illustrated in FIG. 2, the slit nozzle 10 according to the present embodiment is configured in a manner that nozzle pressure, which is gas pressure inside the slit nozzle 10, and a jet angle, a back face inclination angle, a back face length, a slit width, and a gap of the slit nozzle 10 satisfy a predetermined relationship, in order to suppress the influence of the outside air suction flow f4 and suppress disturbance in the gas jet flow f1. A detailed configuration of the slit nozzle 10 and the relationship with nozzle pressure will be described later.

The gap measurement device 30 measures a distance (hereinafter also referred to as "gap") between the jetting port 112 at the tip of the slit nozzle 10 and the surface of the steel sheet S. As illustrated in FIGS. 3 and 4, the gap measurement device 30 is provided on each of both sides in the slit length direction (Y direction) of the jetting port 112 of the slit nozzle 10. Providing the gap measurement device 30 at this position makes it possible to detect an inclination of the jetting port 112 of the slit nozzle 10 with respect to the surface of the steel sheet S in the slit length direction, so that the gap can be adjusted to be constant in the slit length direction. The gap measurement device 30 may be provided at substantially the same position as the gap adjustment mechanism 40, which moves the slit nozzle 10 vertically, in the slit length direction, for example.

The gap measurement device 30 includes a distance sensor 31 such as a laser rangefinder. The gap measurement device 30 measures the gap on the basis of, for example, a phase difference between laser light emitted to the steel sheet S and reflected light of the laser light off the surface of the steel sheet S, with the distance sensor 31 made to face the surface of the steel sheet S. For example, one distance sensor 31 may be provided for each gap measurement device 30 as illustrated in FIG. 4, or a plurality of distance sensors 31 may be provided in the slit length direction. The distance sensor 31 is disposed near each of both ends 112*e* of the jetting port 112. In the present embodiment, near each of the both ends 112*e* of the jetting port 112 refers to ranges of ±¼w from each of the both ends 112*e* of the jetting port 112, where a length of the jetting port 112 of the slit nozzle 10 in the slit length direction is denoted by a slit length W. In addition, since the distance sensor 31 needs to face the steel sheet S, its installation position is decided in accordance with, for example, a minimum sheet width and a maximum sheet width of the steel sheet S that can be passed in a line in which a liquid removal device 10 is installed. Thus, the distance sensor 31 is installed near each of the both ends 112*e* of the jetting port 112 so as to face the steel sheet S. For example, the distance sensor 31 may be installed at a position on the inner side than an end of the steel sheet S by approximately ⅙ of a sheet width. The gap measurement device 30 outputs, as a gap measurement value, a gap obtained on the basis of a detection result of the distance sensor 31 to the gap adjustment mechanism 40.

The gap adjustment mechanism 40 adjusts the gap to a predetermined size on the basis of a measurement result of the gap measurement device 30. The gap adjustment mechanism 40 according to the present embodiment includes a drive section 41 that moves the slit nozzle 10 vertically (in a Z direction) and a control section (not illustrated) that controls driving of the drive section 41.

As illustrated in FIGS. 3 and 4, the drive section 41 is provided on each of both sides in the slit length direction (Y direction) of the jetting port 112 of the slit nozzle 10, and supports the slit nozzle 10 via support members 51, 53, and 55. Installing the drive section 41 in this manner can make the distance between the jetting port 112 and the steel sheet S in the slit length direction of the jetting port 112 uniform. The drive section 41 includes a cylinder, for example, and can adjust a height position of the slit nozzle 10 by moving a piston to which the support member 55 is fixed. Note that the present invention is not limited to this example, and the drive section 41 may be an actuator that changes a height position of a table roll on which the steel sheet S is placed, for example. The gap can be adjusted also by thus bringing the table roll close to or away from the jetting port 112 of the slit nozzle 10.

The control section drives each drive section 41 in a manner that the jetting port 112 is brought as close as possible to the steel sheet S to the extent of not coming into contact with the steel sheet S, on the basis of the measurement result of the gap measurement device 30, to adjust the height position of the slit nozzle 10. Since the gap measurement value obtained by the gap measurement device 30 is a distance from the distance sensor to the surface of the steel sheet S, the control section takes a value obtained by subtracting a distance between the distance sensor and the jetting port 112 of the slit nozzle 10 from the gap measurement value as a current gap, and adjusts the height position of the slit nozzle 10 to within a predetermined range. Gap adjustment by the control section can cause gas jetted from the slit nozzle 10 to flow into a space between a nozzle back face of the slit nozzle 10 and the steel sheet S, making it possible to suppress the influence of the outside air suction flow (f4) on the gas jet flow (f1), as illustrated in FIG. 2. To achieve this action, the gap is preferably set to 20 mm or less by the gap adjustment mechanism 40.

(2-2. Relationship Between Configuration of Slit Nozzle and Nozzle Pressure)

As described above, the slit nozzle 10 according to the present embodiment is configured in a manner that nozzle pressure of the slit nozzle 10, and a jet angle, a back face inclination angle, a back face length, a slit width, and a gap of the slit nozzle 10 satisfy a predetermined relationship, in order to suppress the influence of the outside air suction flow f4 and suppress disturbance in the gas jet flow f1.

Figure 5:
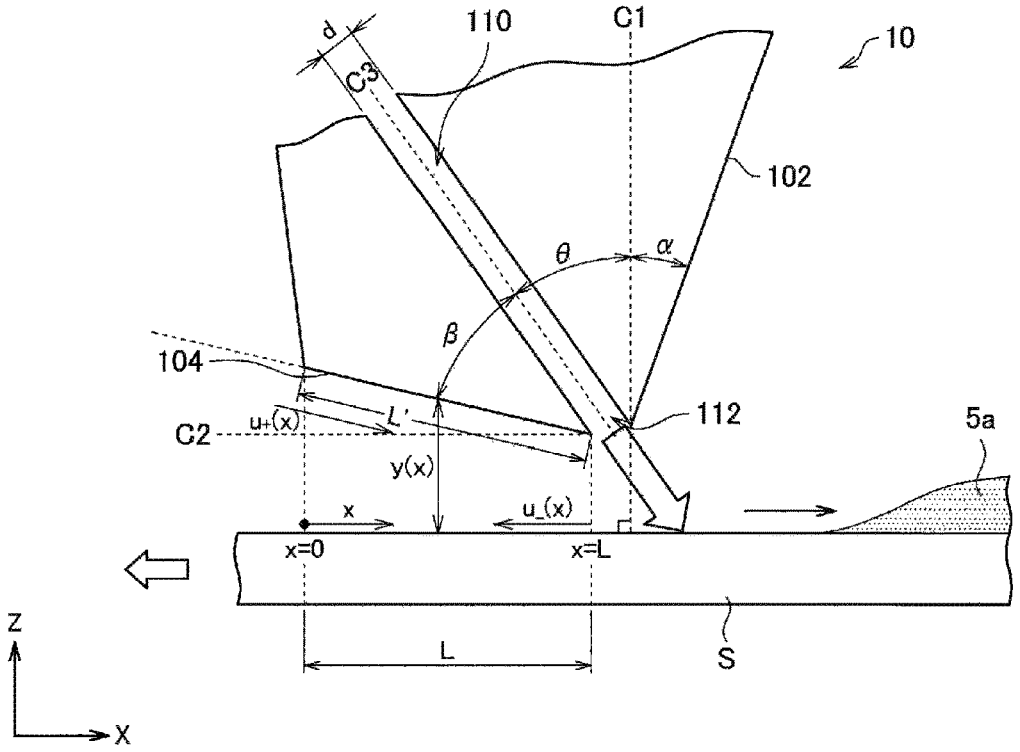
FIG. 5 is an explanatory diagram illustrating a detailed configuration of a slit nozzle according to the embodiment.

FIG. 5 is an explanatory diagram illustrating a detailed configuration of the slit nozzle 10 according to the present embodiment. As illustrated in FIG. 5, the slit nozzle 10 includes a nozzle front face 102 extending from the jetting port 112 toward the upstream side in the conveyance direction of the steel sheet S and the nozzle back face 104 extending from the jetting port 112 toward the downstream side in the conveyance direction of the steel sheet S. An inclination of the nozzle front face 102 toward the upstream side in the conveyance direction is suppressed, and the nozzle back face 104 is provided to extend along the surface of the steel sheet S toward the downstream side in the conveyance direction.

Here, a direction perpendicular to the surface of the steel sheet S is denoted by a reference direction C1, an angle formed by the reference direction C1 and a gas jet direction C3 from the jetting port 112 of the slit nozzle 10 is denoted by a jet angle θ [°], an angle formed by the reference direction C1 and the nozzle front face 102 is denoted by a front face inclination angle α [°], and an angle formed by the gas jet direction C3 and the nozzle back face 104 is denoted by a back face inclination angle β [°]. In addition, a length of the nozzle back face 104 in a conveyance direction C2 of the steel sheet S is denoted by a back face length L [mm]. The liquid removal device 1 is configured to satisfy relations of the following formulas (1) to (3), where a distance between the jetting port 112 and the surface of the steel sheet S is denoted by a gap h [mm], an open width of a slit of the slit nozzle 10 is denoted by a slit width d [mm], and gas pressure inside the slit nozzle 10 is denoted by nozzle pressure $P_n$ [KPa].

[Math. 2]

$$P_n \geq F(h, L, \beta, \theta, d) = 2.0\times10^{10}(h/d)^{0.6}\left(\frac{1}{1+\exp(\beta+\theta-58)}+1\right)^4 L^{-7} \quad (1)$$

$$\beta+\theta \geq 60° \quad (2)$$

$$L \geq 20 \text{ mm} \quad (3)$$

Note that the jet angle θ and the back face inclination angle β indicate size, and are expressed by values of 0 or more. In regard to the front face inclination angle α, an inclination toward the upstream side in the conveyance direction of the steel sheet S and an inclination toward the downstream side are expressed respectively by a positive value and a negative value, with respect to the reference direction C1 as 0°. In addition, as illustrated in FIG. 3, for example, the back face length L when the nozzle back face 104 is not parallel to the steel sheet S can be calculated by L' cos(90°−θ−P), where the actual back face length is denoted by L' [mm]. Thus, the back face length L corresponds to a length of the nozzle back face 104 in the conveyance direction (X direction) on a horizontal projection plane when the nozzle back face 104 is projected onto the horizontal projection plane.

(a. Relationship with Nozzle Pressure $P_n$)

First, the above formula (1) expresses a condition for suppressing the influence of the outside air suction flow f4 and suppressing disturbance in the gas jet flow f1, which is illustrated in FIGS. 1 and 2. Here, in regard to the slit nozzle 10 illustrated in FIG. 5, physical quantities are defined as follows. "x" indicates a position in the conveyance direction of the steel sheet S. A position of the nozzle back face 104 farthest on the downstream side in the conveyance direction (X direction) of the steel sheet S is denoted by a reference position (x=0).

$u_+(x)$: flow velocity of flow pulled in toward jetting port side by Coanda effect $u_-(x)$: flow velocity of conveyance-direction (X-direction) component of gas jet flow having collided with steel sheet y(x): distance between steel sheet and nozzle back face λ: pipe friction coefficient In distribution of $u_+$ in the X direction, flow velocity decreases from an initial velocity $u_+(0)$ by pressure loss as proceeding in the X direction, where the initial velocity $u_+(0)$ is a magnitude of 10% of a fast jet flow based on past experience. Quantitatively, pressure loss with respect to the position in the X direction is given by the following formula (1-1).

[Math. 3]

$$\Delta P_+(x) = \int_x^{x+dx} \frac{\lambda}{y(x)} \rho u_+^2 dx \quad (1\text{-}1)$$

A fluctuation of pressure loss expressed by the above formula (1-1) is substituted into the following formula (1-2); thus, a velocity decrease $\Delta u_+(x)$ is obtained.

[Math. 4]

$$\Delta u_+(x) = \sqrt{2\Delta P_+/\rho} \quad (1\text{-}2)$$

Then, according to the following formula (1-3), a velocity $u_+(x+dx)$ at a position x+dx is obtained by subtracting the obtained velocity decrease $\Delta u_+(x)$ from a velocity $u_+(x)$ at the previous position.

[Math. 5]

$$\Delta u_+(x+dx) = u_+(x) - \Delta u_+(x) \quad (1\text{-}3)$$

On the other hand, a flow velocity u_(x) of a conveyance-direction component of a gas jet flow having collided with the steel sheet is obtained by the following formula (1-4) using a flow velocity u of a gas jet flow jetted from the slit nozzle 10.

[Math. 6]

$$u_-(x) = u(1-\cos\theta) \times d/y(x) \quad (1\text{-}4)$$

Here, as illustrated in FIG. 5, a discussion is made regarding magnitudes of a flow velocity $u_+(L)$ of a flow pulled in toward the jetting port 112 side by the Coanda effect and a flow velocity u_(L) of a conveyance-direction component of a gas jet flow having collided with the steel sheet S, at a position away from the reference position (x=0) toward the upstream side in the conveyance direction by the back face length L of the nozzle back face 104.

First, a case where the flow velocity $u_+(L)$ is equal to or less than the flow velocity u_(L) ($u_+(L) < u_-(L)$) is, in other words, a case where the flow velocity u_(L) of the conveyance-direction component of the gas jet flow is equal to or greater than the flow velocity $u_+(L)$ of the flow pulled in by the Coanda effect. Therefore, the gas jet flow f1 is not influenced by the flow velocity $u_+(L)$ of the flow pulled in by the Coanda effect, and does not vibrate. Consequently, the gas jet flow f1 collides with the steel sheet S without being disturbed, and liquid draining capability of the liquid removal device 1 is exhibited as illustrated in FIG. 2.

On the other hand, a case where the flow velocity $u_+(L)$ is greater than the flow velocity u_(L) ($u_+(L) > u_-(L)$) is, in other words, a case where the flow velocity $u_+(L)$ of the flow pulled in by the Coanda effect is greater than the flow velocity u_ (L) of the conveyance-direction component of the gas jet flow. At this time, the gas jet flow f1 is influenced by the flow velocity $u_+(L)$ of the flow pulled in by the Coanda effect. Consequently, the gas jet flow f1 vibrates in the horizontal direction, and pressure of collision of the gas flow jet f1 with the steel sheet S decreases, which leads to a decrease in liquid draining capability of the liquid removal device 1 as illustrated in FIG. 1.

According to the above description, liquid draining capability of the liquid removal device 1 can be exhibited by making the flow velocity u_(L) of the conveyance-direction component of the gas jet flow equal to or greater than the flow velocity $u_+(L)$ of the flow pulled in by the Coanda effect. That is, a state in which liquid draining capability of the liquid removal device 1 is exhibited can be achieved by considering the balance between the flow velocity $u_+$ and the flow velocity u_ at a gas jet flow ejection position at a position x=L.

Figure 6:
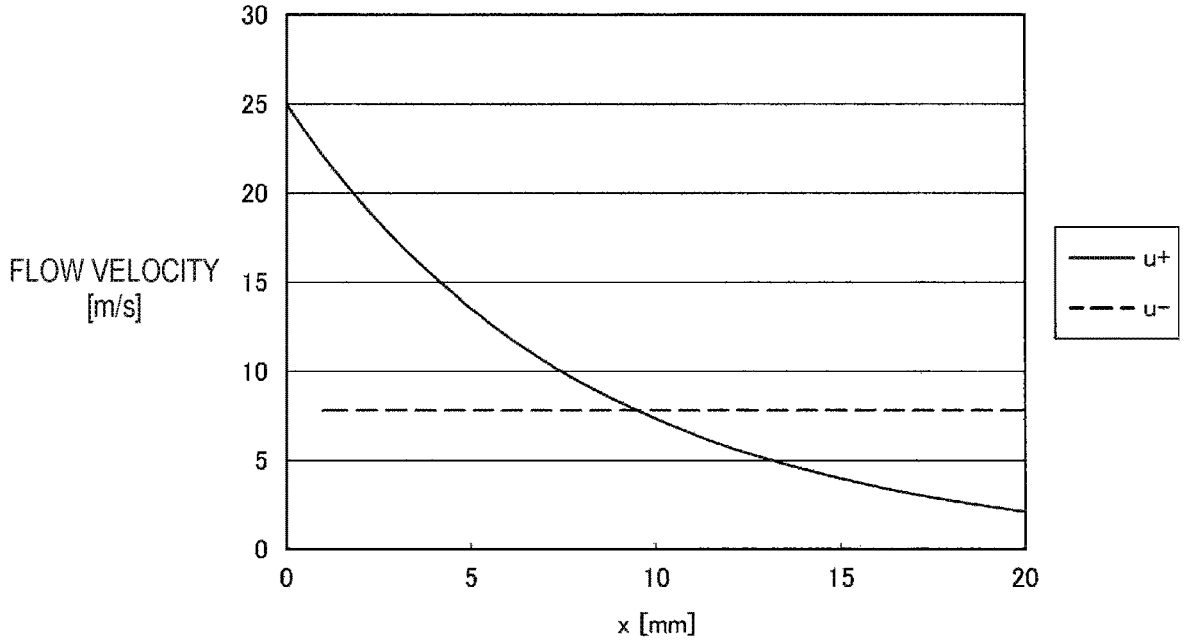
FIG. 6 is an explanatory diagram showing an example of the relationship between a flow velocity $u_+(x)$ and a flow velocity $u_-(x)$ when a back face length L is set to 20 mm and the sum of a jet angle θ and a back face inclination angle β is set to 900.

For example, FIG. 6 shows an example of the relationship between the flow velocity $u_+(x)$ of the flow pulled in toward the jetting port 112 side by the Coanda effect and the flow velocity u_(x) of the conveyance-direction component of the gas jet flow having collided with the steel sheet S when the back face length L is set to 20 mm and the sum of the jet angle θ and the back face inclination angle β is set to 90°. As shown in FIG. 6, at a position away from the reference position (x=0) toward the upstream side in the conveyance direction by greater than 10 mm, the flow velocity u_(x) of the conveyance-direction component of the gas jet flow is larger than the flow velocity $u_+(x)$ of the flow pulled in toward the jetting port 112 side by the Coanda effect. Consequently, in the case where the back face length L is 20 mm, since the flow velocity u_(x) of the conveyance-direction component of the gas jet flow is larger than the flow velocity $u_+(x)$ of the flow pulled in toward the jetting port 112 side by the Coanda effect, the flow on the nozzle back face 104 is rectified.

Figure 7:
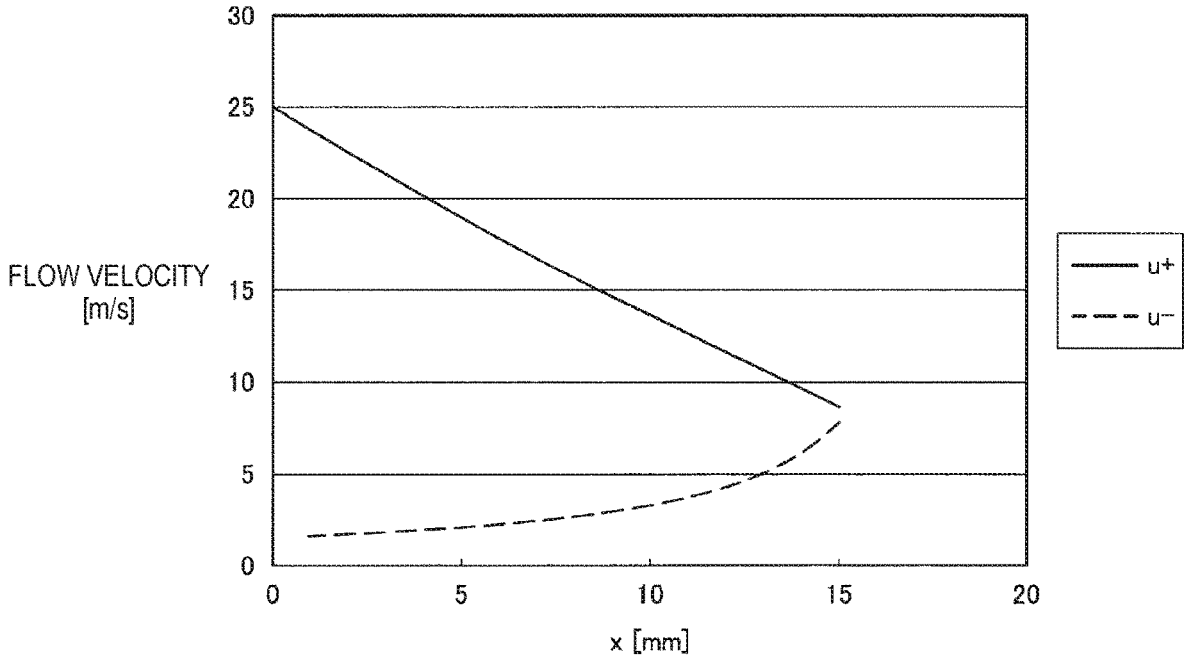
FIG. 7 is an explanatory diagram showing an example of the relationship between the flow velocity $u_+(x)$ and the flow velocity $u_-(x)$ when the back face length L is set to 15 mm and the sum of the jet angle θ and the back face inclination angle β is set to 50°.

On the other hand, for example, FIG. 7 shows an example of the relationship between the flow velocity $u_+(x)$ of the flow pulled in toward the jetting port 112 side by the Coanda effect and the flow velocity u_(x) of the conveyance-direction component of the gas jet flow having collided with the steel sheet S when the back face length L is set to 15 mm and the sum of the jet angle θ and the back face inclination angle β is set to 50°. As shown in FIG. 7, even at a position away from the reference position (x=0) toward the upstream side in the conveyance direction by 15 mm, the flow velocity u_(x) of the conveyance-direction component of the gas jet flow is smaller than the flow velocity $u_+(x)$ of the flow pulled in toward the jetting port 112 side by the Coanda effect. Therefore, in the case where the back face length L is 15 mm, since the flow velocity u_(x) of the conveyance-direction component of the gas jet flow is smaller than the flow velocity $u_+(x)$ of the flow pulled in toward the jetting port 112 side by the Coanda effect, the flow on the nozzle back face 104 becomes turbulent, so that the gas jet flow f1 is disturbed.

Hence, the present inventors studied a configuration and setting of the liquid removal device 1 that make the flow velocity u_(L) of the conveyance-direction component of the gas jet flow equal to or greater than the flow velocity $u_+(L)$ of the flow pulled in by the Coanda effect, and consequently arrived at the relational formula of the above formula (1). That is, configuring and disposing the slit nozzle 10 in a manner that the nozzle pressure $P_n$ [KPa] of the slit nozzle 10 is equal to or greater than a value of a relational formula F(h, L, β, θ, d) expressed by the gap h [mm], the back face length L [mm], the back face inclination angle β [°], the slid width d [mm], and the jet angle θ [°] makes it possible to suppress the influence of the outside air suction flow f4 and suppress disturbance in the gas jet flow f1.

The relational formula F(h, L, β, θ, d) can be obtained by visualizing the flow on the nozzle back face 104 of the slit nozzle 10 by a tuft method, for example, and specifying the nozzle pressure $P_n$ at which the flow on the nozzle back face 104 is rectified. The above formula (1) was set by measuring, by a tuft method, a threshold of the nozzle pressure $P_n$ at which the flow on the nozzle back face 104 is rectified when the slid width d was set to 0.4 mm, the gap h, the back face length L, the back face inclination angle β, and the jet angle θ were respectively set in ranges of 1 mm to 25 mm, 10 to 50 mm, 5 to 45°, and 0 to 75°, and the nozzle pressure $P_n$ was gradually changed from 5 to 1000 KPa.

Specifically, the flow on the nozzle back face 104 was visualized by disposing polyethylene yarns with a diameter of 0.025 mm and a length of 3 mm on the nozzle back face 104 at a 5-mm pitch along the conveyance direction of the steel sheet S, and allowing the yarns to be moved by the flow on the nozzle back face 104 that changes in accordance with the nozzle pressure $P_n$. When all the yarns provided on the nozzle back face 104 faced the conveyance direction of the steel sheet S, the flow on the nozzle back face 104 was determined to be rectified, and the nozzle pressure $P_n$ at this time was taken as the threshold. Then, the above formula (1) was obtained by performing multivariable multiple regression analysis on the gap h, the back face length L, the back face inclination angle β, and the jet angle θ, in regard to each of thresholds of the nozzle pressure $P_n$ obtained by varying the gap h, the back face length L, the back face inclination angle β, and the jet angle θ.

In the case where the value of the relational formula F(h, L, β, θ, d) of the formula (1) obtained in this manner is equal to or less than the nozzle pressure $P_n$ of the slit nozzle 10, the flow velocity u_(L) of the conveyance-direction component of the gas jet flow is equal to or greater than the flow velocity $u_+(L)$ of the flow pulled in by the Coanda effect. At this time, the gas jet flow f1 collides with the steel sheet S without being disturbed, and the liquid removal device 1 exhibits liquid draining capability. Therefore, configuring and setting the liquid removal device 1 to satisfy the above formula (1) makes it possible to remove liquid on the steel sheet S.

In addition, the gap h, the back face length L, the back face inclination angle β, and the jet angle θ are set as follows.

(b. Jet Angle θ and Back Face Inclination Angle β)

The jet angle θ and the back face inclination angle β are set in a manner that their sum is 60° or more, as expressed by the above formula (2). The sum of the jet angle θ and the back face inclination angle β indicates an inclination state of the nozzle back face 104 with respect to the reference direction C1. When the sum of the jet angle θ and the back face inclination angle β is 90°, the nozzle back face 104 is parallel to the surface of the steel sheet S. If the sum of the jet angle θ and the back face inclination angle β is smaller than 60°, interference between the outside air suction flow f4 and the reverse flow f3 after collision with the surface of the steel sheet S occurs, causing a decrease in collision pressure of the gas jet flow f1, so that the liquid 5*a* on the surface of the steel sheet S cannot be removed. Therefore, the sum of the jet angle θ and the back face inclination angle β is set to 60° or more. Note that an upper limit of the sum of the jet angle θ and the back face inclination angle β is a maximum value in a range within which the nozzle back face 104 does not come into contact with the surface of the steel sheet S.

The nozzle back face 104 is preferably disposed to be parallel to the surface of the steel sheet S. That is, the sum of the jet angle θ and the back face inclination angle β is preferably set to 90°. Thus, after the gas jet flow f1 collides with the surface of the steel sheet S, the reverse flow f3 toward the downstream side in the conveyance direction of the steel sheet S can smoothly flow between the nozzle back face 104 and the surface of the steel sheet S.

In addition, the gas jet angle θ is preferably set to 45°. Thus, gas jetted from the jetting port 112 of the slit nozzle 10 can collide at an angle of 45° from the downstream side in the conveyance direction with respect to the surface of the steel sheet S, and effectively push back the liquid 5*a* on the surface of the steel sheet S toward the upstream side in the conveyance direction to remove it. Taking into consideration that the sum of the jet angle θ and the back face inclination angle β is preferably 90°, the jet angle θ and the back face inclination angle β are each preferably set to 45°.

(c. Back Face Length L)

The back face length L of the nozzle back face 104 is set to 20 mm or more as shown in the formula (3). If the back face length L is smaller than 20 mm, the outside air suction flow f4 and the reverse flow f3 collide with each other in the neighborhood of the gas jet flow f1 to disturb the gas jet flow f1. Hence, setting the back face length L to 20 mm or more prevents collision between the outside air suction flow f4 and the reverse flow f3 from occurring in the neighborhood of the gas jet flow f1, and suppresses disturbance in the gas jet flow f1 due to the outside air suction flow f4. In addition, setting the back face length L to 20 mm or more causes pressure of the reverse flow f3 to decrease before collision of the outside air suction flow f4, which makes disturbance in air small when the outside air suction flow f4 and the reverse flow f3 collide with each other. Making the back face length L larger also makes the outside air suction flow f4 less likely to enter a zone between the nozzle back face 104 and the surface of the steel sheet S. Therefore, the back face length L is preferably set to 20 mm or more.

Note that an upper limit of the back face length L of the nozzle back face 104 is not particularly limited, as long as no contact is made with another member, in terms of equipment. For example, the back face length L may be up to approximately 100 mm.

(d. Gap h)

The gap h, which is the distance between the jetting port 112 and the surface of the steel sheet S, is preferably set in a manner that the jetting port 112 is brought as close as possible to the steel sheet S to the extent of not coming into contact with the steel sheet S, as described above. This can cause gas jetted from the slit nozzle 10 to flow into a space between the nozzle back face of the slit nozzle 10 and the steel sheet S, making it possible to suppress the influence of the outside air suction flow f4 on the gas jet flow f1, as illustrated in FIG. 2. To achieve this action, the gap h is preferably set to 20 mm or less, for example.

Note that the front face inclination angle α is not particularly limited, but may be set to 30° or less. If the front face inclination angle α is larger than 30°, the nozzle front face 102 is excessively inclined toward the upstream side in the conveyance direction; thus, after the gas jet flow f1 collides with the surface of the steel sheet S, the flow f2 toward the upstream side in the conveyance direction is likely to become a flow going toward the jetting port 112 of the slit nozzle 10 again along the nozzle front face 102, without going toward the upstream side as it is. When such a flow is formed, removal performance of the liquid 5*a* on the surface of the steel sheet S by the flow f2 decreases. Therefore, to suppress a decrease in liquid removal performance, the front face inclination angle α may be set to 30° or less. It is preferable that the front face inclination angle α be 0° or less. This makes it possible to more reliably prevent the flow f2 toward the upstream side in the conveyance direction from becoming a flow going toward the jetting port 112 of the slit nozzle 10 again along the nozzle front face 102.

According to the above description, the slit nozzle 10 is configured and disposed so as to satisfy the above formulas (1) to (3). This can reduce disturbance in the gas jet flow f1 due to collision between the outside air suction flow f4 and the reverse flow f3, preventing a decrease in collision pressure when the gas jet flow f1 collides with the surface of the steel sheet S, and enabling pressure of the flow f2 toward the upstream side in the conveyance direction to be maintained.

Consequently, the liquid 5*a* on the steel sheet S can be sufficiently removed. The liquid removal device 1 according to the present embodiment can sufficiently remove liquid on a steel sheet without using wringer rolls and a drier, and thus can reduce cost for maintaining equipment.

Figure 8:
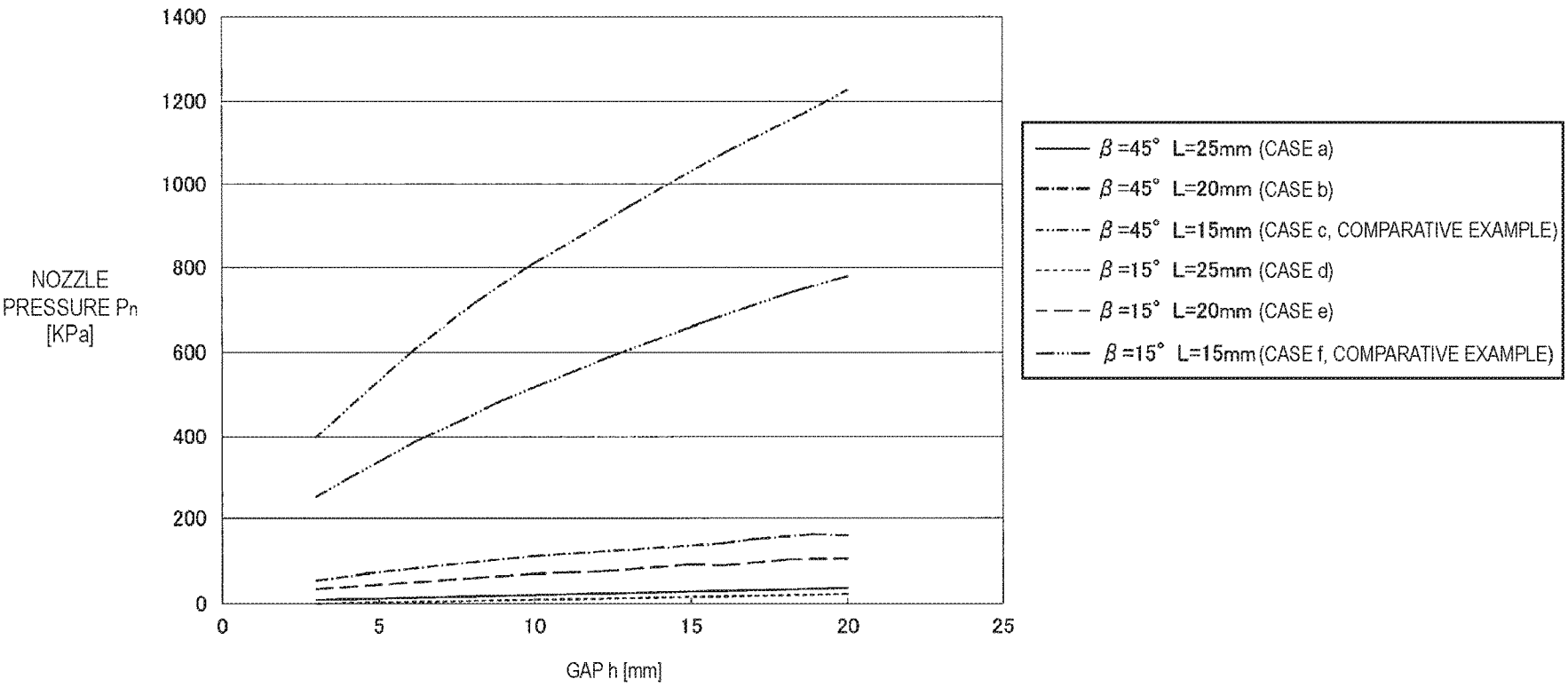
FIG. 8 is an explanatory diagram showing the relationship between a gap h and nozzle pressure $P_n$ when the jet angle θ is set to 45° and the back face inclination angle β and the back face length L are changed.
Figure 9:
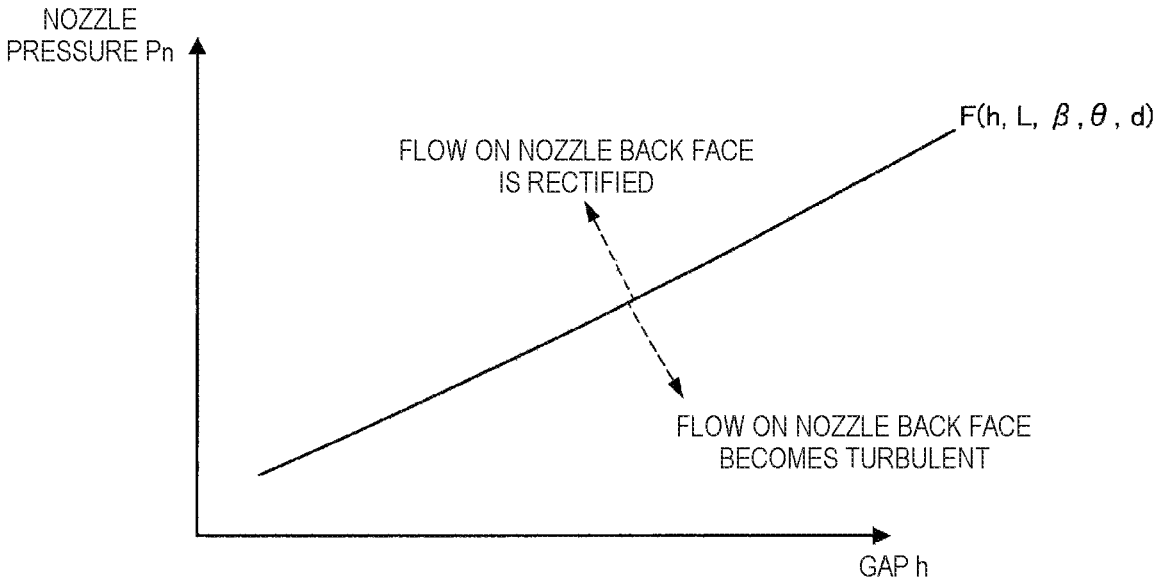
FIG. 9 is an explanatory diagram for describing a state of flow on a nozzle back face, in regard to plot lines in FIG. 8.

Here, FIG. 8 shows the relationship between the gap h and the nozzle pressure $P_n$ calculated by the above formula (1) when the jet angle θ is set to 45° and the back face inclination angle β and the back face length L are changed. The nozzle pressure $P_n$ shown in FIG. 8 indicates a threshold when the flow on the nozzle back face 104 is determined to be rectified according to the above-described tuft method, and is a value when both sides of the formula (1) indicate the same value ($P_n$=F(h, L, β, θ, d)). That is, plot lines of cases a to f in FIG. 8 each indicate the boundary between a region in which the flow on the nozzle back face 104 is rectified and a region in which the flow on the nozzle back face 104 becomes turbulent. As shown in FIG. 9, on the plot line or on the upper side with respect to the plot line, the nozzle pressure $P_n$ is equal to or greater than the value of the relational formula F(h, L, β, θ, d), satisfying the relation of the above formula (1); thus, the flow on the nozzle back face 104 is rectified. On the other hand, on the lower side with respect to the plot line, the nozzle pressure $P_n$ is smaller than the value of the relational formula F(h, L, β, θ, d), not satisfying the relation of the above formula (1). Consequently, the flow on the nozzle back face 104 becomes turbulent, and the gas jet flow f1 is disturbed.

In FIG. 8, the sum of the back face inclination angle β and the jet angle θ is 90° in cases a to c and 60° in cases d to f, both satisfying the above formula (2). The back face length L is 25 mm or 20 mm in cases a, b, d, and e, satisfying the above formula (3), but is 15 mm in cases c and f, not satisfying the above formula (3). As shown in FIG. 8, the plot lines of cases c and f not satisfying the above formula (3) have larger slopes than the plot lines of cases a, b, d, and e satisfying the above formula (3), and a nozzle pressure $P_n$ of 200 KPa or more is needed even in the case where the gap h is as close as 3 mm. If a nozzle pressure $P_n$ of 200 KPa or more is needed, the pressure cannot be ensured and the liquid removal device 1 cannot be installed depending on a piping installation situation in a factory, or even if the liquid removal device 1 can be installed, a very high air flow rate is assumed to be required, leading to an increase in cost, for example. Therefore, the back face length L is preferably set to 20 mm or more.

On the other hand, the plot lines of cases a, b, d, and e have similar slopes, and the above formula (1) can be satisfied even if the gap h is large or the nozzle pressure $P_n$ of the slit nozzle 10 is set smaller than 200 KPa. Note that in the case where the back face length L is the same, a larger sum of the back face inclination angle β and the jet angle θ can make the required nozzle pressure $P_n$ smaller.

As described above, the slit nozzle 10 is configured and disposed so as to satisfy the above formulas (1) to (3); thus, the flow on the nozzle back face 104 can be rectified and prevented from influencing the flow of the gas jet flow f1. Consequently, a liquid removal device capable of ensuring versatility of air pressure and having an economical air flow rate can be achieved.

2-3. Modification Example

Figure 10:
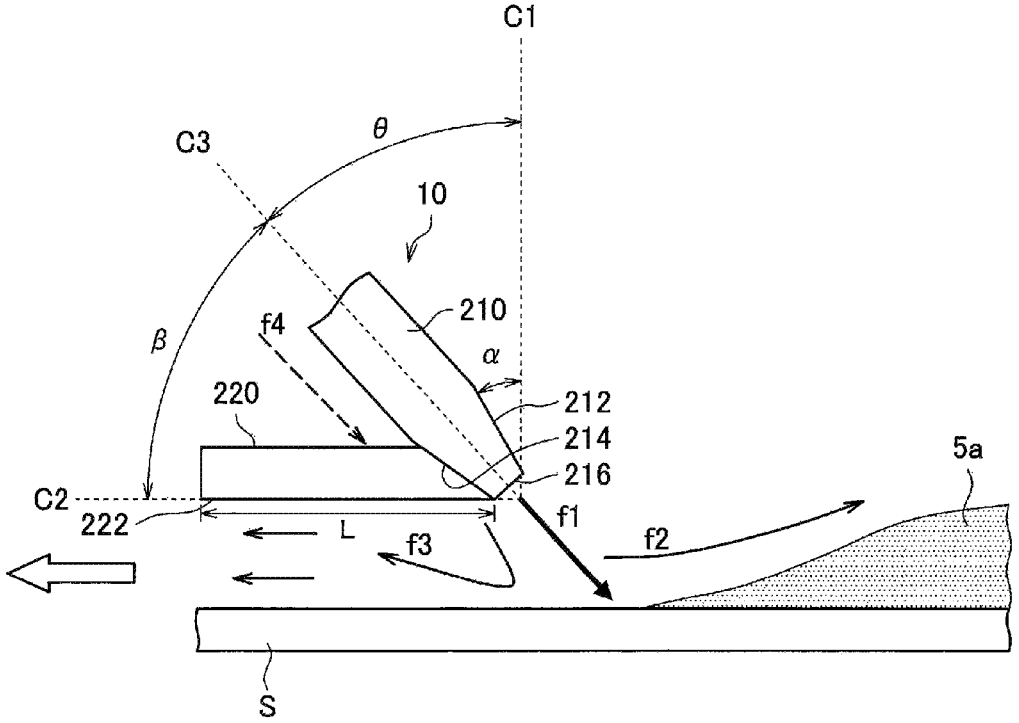
FIG. 10 is an explanatory diagram illustrating a modification example of a nozzle configuration of a liquid removal device according to the embodiment.

The slit nozzle 10 of the liquid removal device 1 illustrated in FIG. 5 illustrates a case where an outside shape of the nozzle itself is formed so as to satisfy the above formulas (1) to (3), but the present invention is not limited to this example. For example, as illustrated in FIG. 10, the slit nozzle 10 of the liquid removal device 1 may include a slit nozzle (hereinafter referred to as "nozzle main body") 210 having an axisymmetric outer shape that is generally used, and a back face member 220. The nozzle main body 210 has a jetting port 216, which is a slit through which gas is jetted. A nozzle main body front face 212 and a nozzle main body back face 214 are symmetric with respect to the gas jet direction C3. The back face member 220 is, for example, a sheet member such as a steel sheet. The back face member 220 is connected to the nozzle main body back face 214, and constitutes a nozzle back face extending from the jetting port 216 of the nozzle main body 210 toward the downstream side in the conveyance direction of the steel sheet S. That is, a counter face of the back face member 220 that faces the surface of the steel sheet S serves as a nozzle back face.

Also in such a slit nozzle 10, the above formulas (1) to (3) are satisfied, and a bottom face 222 of the back face member 220 that functions as a nozzle back face is provided to extend along the surface of the steel sheet S toward the downstream side in the conveyance direction. This can, as with the slit nozzle 10 illustrated in FIG. 5, reduce disturbance in the gas jet flow f1 due to collision between the outside air suction flow f4 and the reverse flow f3, preventing a decrease in collision pressure when the gas jet flow f1 collides with the surface of the steel sheet S, and enabling pressure of the flow f2 toward the upstream side in the conveyance direction to be maintained; therefore, the liquid 5*a* on the steel sheet S can be sufficiently removed.

The configuration illustrated in FIG. 10 is implementable by providing the back face member 220 on the nozzle main body 210, which is an existing slit nozzle, requiring few changes to existing equipment. A liquid removal device with such a configuration can also sufficiently provide an effect of removing liquid on the surface of the steel sheet S.

<3. Liquid Removal Method>

Liquid attached to the surface of the steel sheet S is removed by causing the slit nozzle 10 of the above-described liquid removal device 1 to face the surface of the steel sheet S and jetting gas from the slit nozzle 10 to the surface of the steel sheet S. At this time, first, a gap between the jetting port 112 of the slit nozzle 10 and the steel sheet S is measured by the gap measurement device 30. Then, the gap is adjusted to 20 mm or less by changing, by driving by the drive section of the gap adjustment mechanism 40, a position of at least one of the slit nozzle 10 and the steel sheet S on the basis of the measured gap. After that, the liquid attached to the surface of the steel sheet S can be removed by jetting gas from the slit nozzle 10 to the surface of the steel sheet S while relatively moving the slit nozzle 10 and the steel sheet S.

Note that gap measurement by the gap measurement device 30 and gap adjustment by the gap adjustment mechanism 40 may be performed for each different steel sheet S to be processed. Alternatively, in the case where sheet thickness changes while the steel sheet S is being passed, an edge wave of a sheet edge also changes, and an allowable size of the gap also changes. Therefore, the gap may be measured by the gap measurement device 30 in real time while the steel sheet S is being passed, and the gap may be adjusted to 20 mm or less by the gap adjustment mechanism 40 on the basis of the acquired gap measurement value.

EXAMPLES

In regard to a slit nozzle used for a liquid removal device of the present invention, a liquid draining effect of removing liquid on a steel sheet surface was verified. In this verification, the liquid removal device according to the present invention was installed subsequent to cleaning equipment of a continuous steel sheet processing line, and a film thickness of liquid remaining on the steel sheet surface after removal of liquid on the steel sheet surface by the liquid removal device was measured. Wringer rolls and a drier were not used. At this time, a line speed of the steel sheet was set to 100 mpm, the gap was set to 3 mm, the jet angle θ was set to 45°, and the slit width d was set to 0.4 mm.

Figure 11:
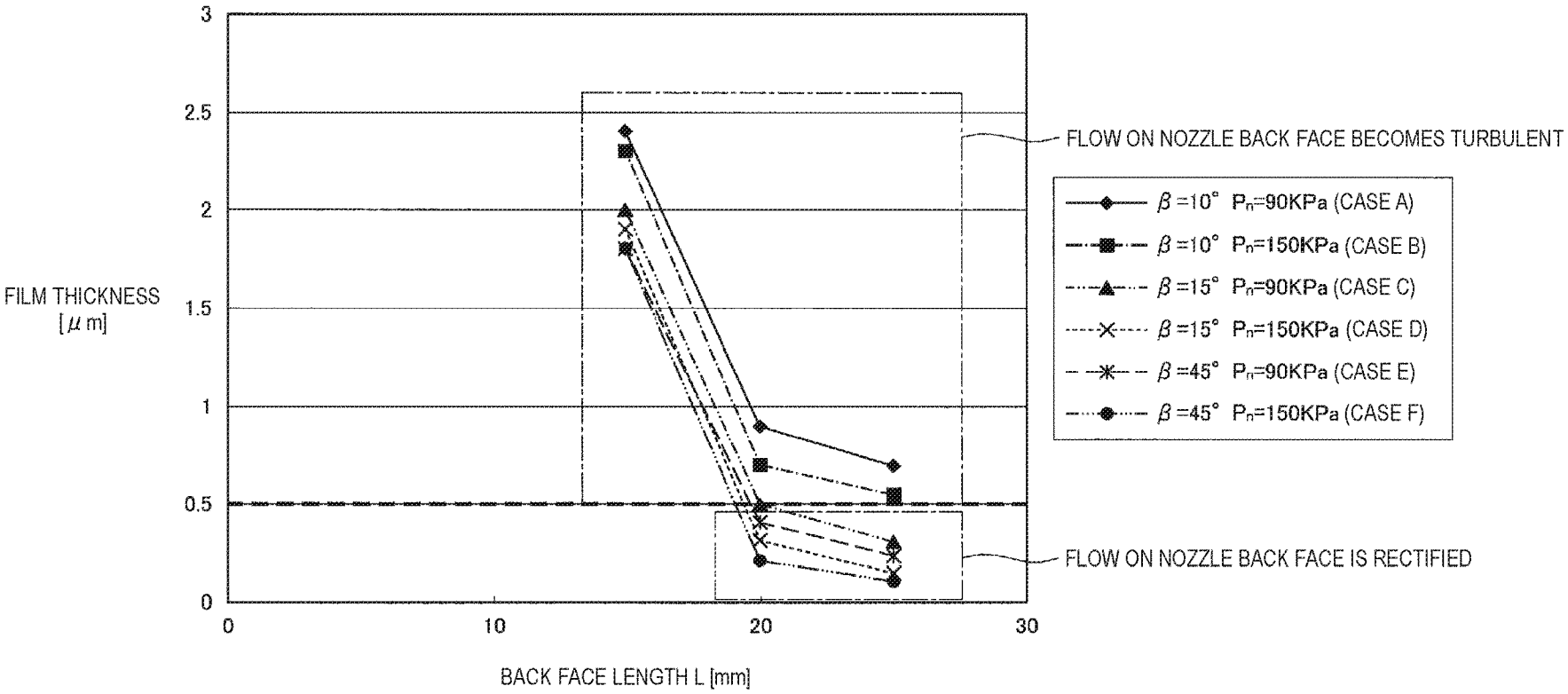
FIG. 11 is a graph showing a relationship between a back face length and a film thickness of liquid remaining on a steel sheet surface when the front face inclination angle α is set to 30°.

Then, the relationship between the back face length L of the nozzle back face and the film thickness of liquid remaining on the steel sheet surface was researched in regard to, with the front face inclination angle α set to 30°, cases where the back face inclination angle β was set to 10°, 15°, 45° (i.e., θ+β=55°, 60°, 90°) and cases where the nozzle pressure $P_n$ was set to 90 KPa, 150 KPa. The results are shown in FIG. 11 and Table 1. In this verification, in regard to six combinations of the back face inclination angle β and the nozzle pressure $P_n$ of cases A to F, a liquid draining effect when the back face length L was changed was evaluated. In Table 1 below, branch numbers "−1", "−2", and "−3" of cases A to F respectively indicate cases where the back face length L was 15 mm, 20 mm, 25 mm.

Figure 13:
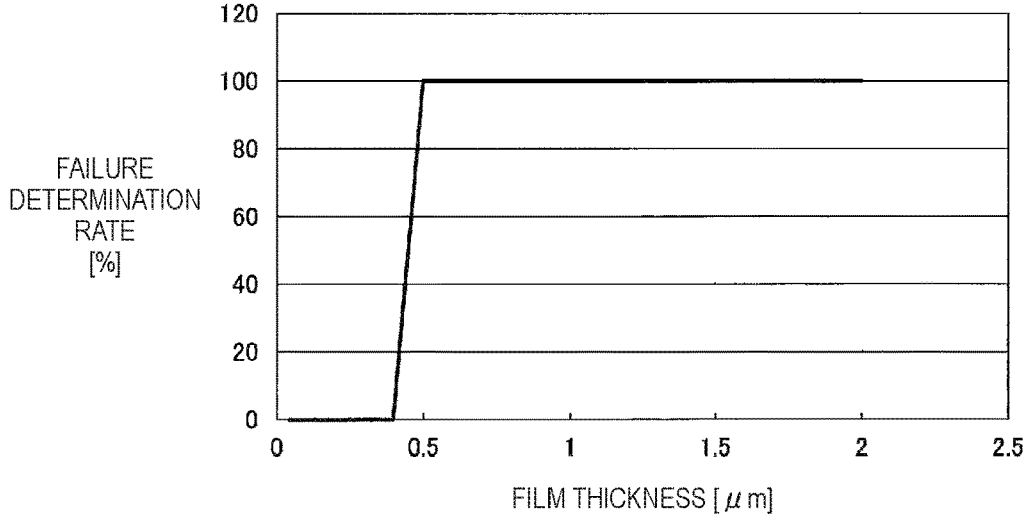
FIG. 13 is an explanatory diagram showing the relationship between a film thickness of liquid on a steel sheet surface and a failure determination rate related to steel sheet quality.

In this verification, a liquid draining effect was evaluated according to the film thickness of remaining liquid after removal of liquid on the steel sheet surface by the liquid removal device. In operation, liquid draining is evaluated by a visual check. Normally, as shown in FIG. 13, remaining of liquid is visually recognized when the film thickness of the liquid on the steel sheet surface is 0.5 μm or more; hence, the steel sheet surface is determined to have a quality failure. Accordingly, a liquid draining effect was evaluated to be obtained when the film thickness of the liquid on the steel sheet surface was smaller than 0.5 μm. In Table 1, "liquid draining effect: yes (○)" indicates a case where the film thickness of the liquid on the steel sheet surface was smaller than 0.5 μm, and "liquid draining effect: no (x)" indicates a case where the film thickness of the liquid on the steel sheet surface was 0.5 μm or more.

TABLE 1

| Case | | Jet angle θ [°] | Front face inclination angle α [°] | Back face inclination angle β [°] | β + θ [°] | Back face length L [mm] | Slit width d [mm] | Gap h [mm] | Value of relational formula F [KPa] | Nozzle pressure Pn [KPa] | Film thickness [μm] | Liquid draining effect |
|---|---|---|---|---|---|---|---|---|---|---|---|---|
| Case A-1 | Comparative Example 1 | 45 | 30 | 10 | 55 | 15 | 0.4 | 3 | 5700 | 90 | 2.4 | x |
| Case A-2 | Comparative Example 2 | 45 | 30 | 10 | 55 | 20 | 0.4 | 3 | 761 | 90 | 0.9 | x |
| Case A-3 | Comparative Example 3 | 45 | 30 | 10 | 55 | 25 | 0.4 | 3 | 160 | 90 | 0.7 | x |
| Case B-1 | Comparative Example 4 | 45 | 30 | 10 | 55 | 15 | 0.4 | 3 | 5700 | 150 | 2.3 | x |
| Case B-2 | Comparative Example 5 | 45 | 30 | 10 | 55 | 20 | 0.4 | 3 | 761 | 150 | 0.7 | x |
| Case B-3 | Comparative Example 6 | 45 | 30 | 10 | 55 | 25 | 0.4 | 3 | 160 | 150 | 0.54 | x |
| Case C-1 | Comparative Example 7 | 45 | 30 | 15 | 60 | 15 | 0.4 | 3 | 615 | 90 | 2 | x |
| Case C-2 | Example 1 | 45 | 30 | 15 | 60 | 20 | 0.4 | 3 | 82 | 90 | 0.48 | ○ |
| Case C-3 | Example 2 | 45 | 30 | 15 | 60 | 25 | 0.4 | 3 | 17 | 90 | 0.3 | ○ |
| Case D-1 | Comparative Example 8 | 45 | 30 | 15 | 60 | 15 | 0.4 | 3 | 615 | 150 | 1.9 | x |
| Case D-2 | Example 3 | 45 | 30 | 15 | 60 | 20 | 0.4 | 3 | 82 | 150 | 0.3 | ○ |
| Case D-3 | Example 4 | 45 | 30 | 15 | 60 | 25 | 0.4 | 3 | 17 | 150 | 0.14 | ○ |
| Case E-1 | Comparative Example 9 | 45 | 30 | 45 | 90 | 15 | 0.4 | 3 | 392 | 90 | 1.8 | x |
| Case E-2 | Example 5 | 45 | 30 | 45 | 90 | 20 | 0.4 | 3 | 52 | 90 | 0.4 | ○ |
| Case E-3 | Example 6 | 45 | 30 | 45 | 90 | 25 | 0.4 | 3 | 11 | 90 | 0.22 | ○ |
| Case F-1 | Comparative Example 10 | 45 | 30 | 45 | 90 | 15 | 0.4 | 3 | 392 | 150 | 1.8 | x |
| Case F-2 | Example 7 | 45 | 30 | 45 | 90 | 20 | 0.4 | 3 | 52 | 150 | 0.4 | ○ |
| Case F-3 | Example 8 | 45 | 30 | 45 | 90 | 25 | 0.4 | 3 | 11 | 150 | 0.22 | ○ |

According to the verification results shown in FIG. 11 and Table 1, in regard to case A (cases A-1, A-2, A-3) and case B (cases B-1, B-2, B-3), the sum of the jet angle θ and the back face inclination angle β was 55°, not satisfying the relation of the above formula (2). Therefore, even though the nozzle pressure $P_n$ or the back face length L of the nozzle back face was changed, the film thickness of the liquid on the steel sheet surface was 0.5 μm or more, and a sufficient liquid draining effect was not able to be obtained.

On the other hand, in regard to cases C to F, the sum of the jet angle θ and the back face inclination angle β was 600 or more, and the slit nozzle was configured so as to satisfy the above formula (2). In regard to these, the film thickness of the liquid on the steel sheet surface was 0.5 μm or more and a sufficient liquid draining effect was not able to be obtained in cases C-1, D-1, E-1, and F-1 in which the back face length L of the nozzle back face was less than 20 mm, whereas the film thickness of the liquid on the steel sheet surface was smaller than 0.5 μm and a sufficient liquid draining effect was recognized in cases C-2, C-3, D-2, D-3, E-2, E-3, F-2, and F-3 in which the back face length L of the nozzle back face was set to 20 mm or more to satisfy the above formula (3). Particularly in cases E-2, E-3, F-2, and F-3 in which the sum of the jet angle θ and the back face inclination angle β was 90°, the film thickness of the liquid on the steel sheet surface was smaller, exhibiting a higher water draining effect, than in cases C-2, C-3, D-2, and D-3 in which the sum of the jet angle θ and the back face inclination angle β was 60°.

In addition, it is found from cases A to F that in the case where conditions of the jet angle θ, the front face inclination angle α, the back face inclination angle β, the slit width d, and the back face length L of the nozzle back face are the same, setting the nozzle pressure $P_n$ higher makes a water draining effect higher.

In regard to a case where a water draining effect was recognized, it is presumed that gas flow was rectified on the nozzle back face of the slit nozzle, as illustrated in FIG. 2. On the other hand, in regard to a case where a water draining effect was not recognized, it is presumed that gas flow became turbulent on the nozzle back face of the slit nozzle and influenced a gas jet flow, as illustrated in FIG. 1.

In addition, the relationship between the gap h and the film thickness of liquid remaining on the steel sheet surface was researched in regard to, with the nozzle pressure $P_n$ set to 90 KPa, a case where the back face inclination angle β was set to 10° (θ+β=55°) and the back face length L of the slit nozzle was set to 15 mm (case A-1 (Comparative Example 1) in Table 1), a case where the back face inclination angle β was set to 15° (θ+β=60°) and the back face length L of the slit nozzle was set to 20 mm (case C-2 (Example 1) in Table 1), and a case where the back face inclination angle β was set to 45° (θ+β=90°) and the back face length L of the slit nozzle was set to 25 mm (case E-3 (Example 6) in Table 1). The results are shown in FIG. 12.

Figure 12:
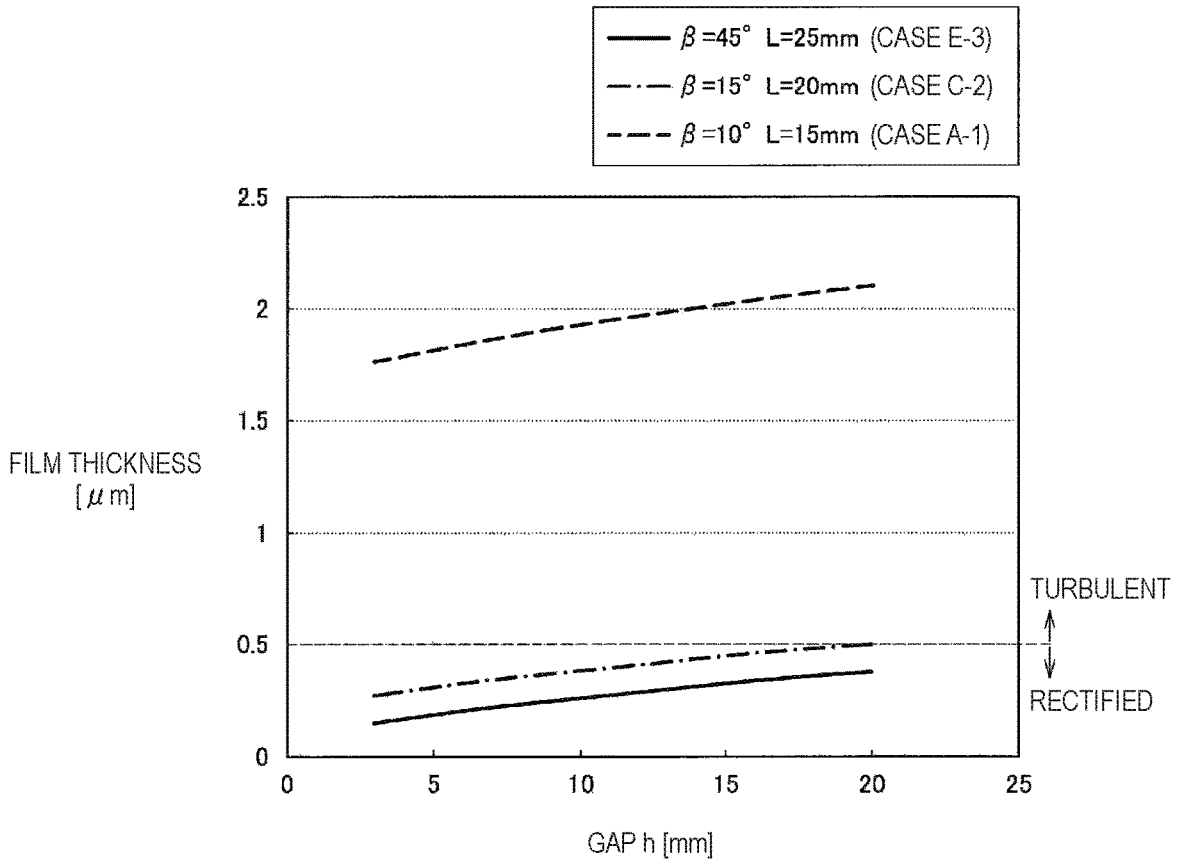
FIG. 12 is a graph showing a relationship between a gap and a film thickness of liquid remaining on a steel sheet surface.

As shown in FIG. 12, in case A-1 (Comparative Example 1) in Table 1, even though the gap h was changed between 3 to 20 mm, the above formulas (1) to (3) were not satisfied. Therefore, the flow on the nozzle back face became turbulent, and the film thickness of the liquid on the steel sheet surface was 0.5 μm or more. On the other hand, in case C-2 (Example 1) and case E-3 (Example 6) in Table 1, the above formulas (1) to (3) were constantly satisfied even though the gap h was changed between 3 to 20 mm, and the film thickness of the liquid on the steel sheet surface was able to be made smaller than 0.5 μm.

The above description shows that a slit nozzle configuration of the liquid removal device of the present invention can prevent occurrence of a quality failure of the steel sheet surface, and provide a sufficient liquid draining effect.

Figure 14:
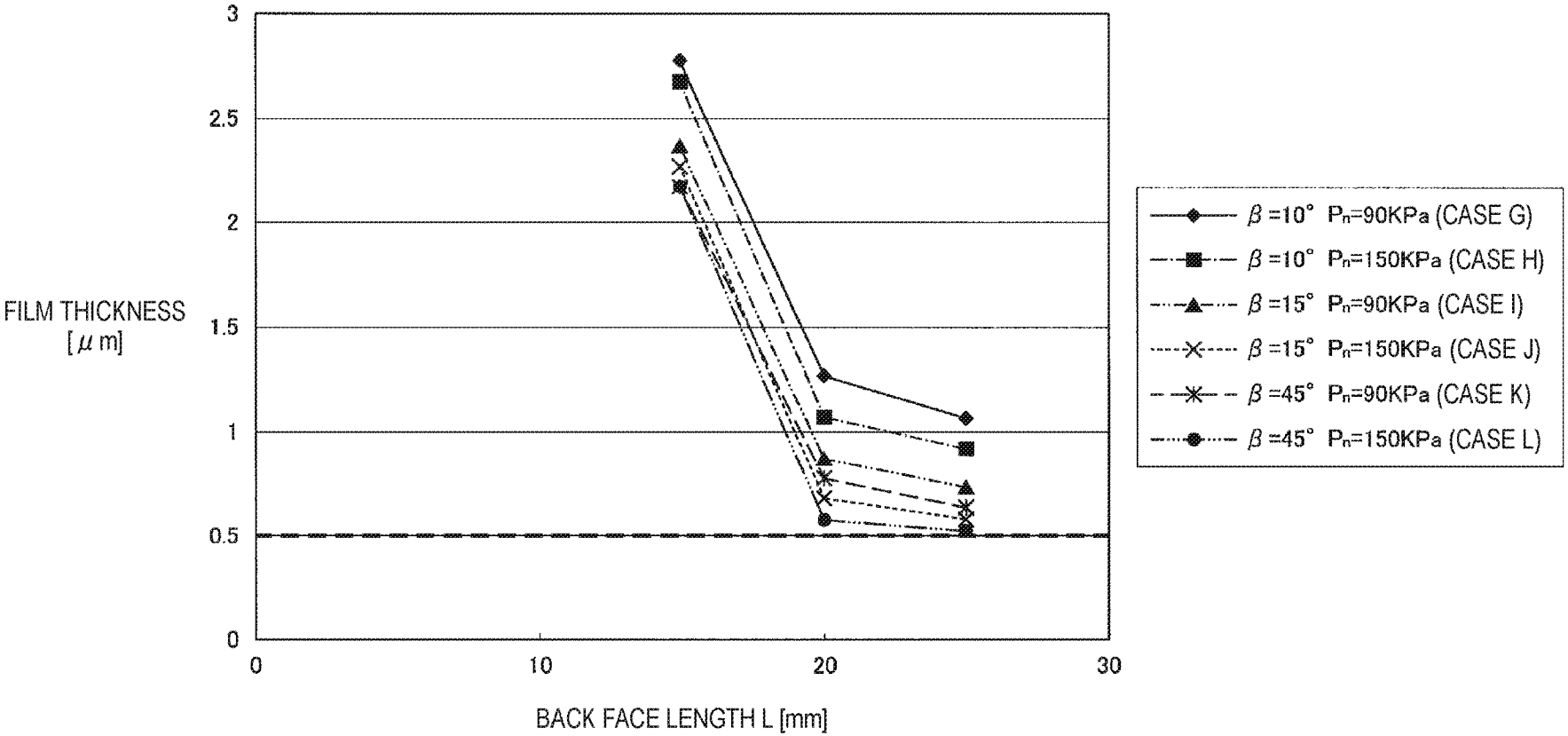
FIG. 14 is a graph showing a relationship between a back face length and a film thickness of liquid remaining on a steel sheet surface when the front face inclination angle α is set to 35°.

Note that in regard to the front face inclination angle α, only the front face inclination angle α in cases A to F was changed to 350, and verification was performed under conditions similar to those of the verification in FIG. 11. Cases G to I in FIG. 14 correspond respectively to cases A to F in FIG. 11. As shown in FIG. 14, even in the case where the jet angle θ, the back face inclination angle β, the back face length L of the nozzle back face, the slit width d, and the gap h, and the nozzle pressure $P_n$ satisfied the relations of the above formulas (1) to (3) according to the results in FIG. 11, the film thickness of the liquid on the steel sheet surface was 0.5 μm or more, and a sufficient liquid draining effect was not able to be obtained. Therefore, the front face inclination angle α is preferably set to 30° or less.

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

For example, in the present embodiment, description is given on a case where the liquid removal device 1 including the slit nozzle 10 is fixed and the steel sheet S moves relatively to the slit nozzle 10 by being conveyed by the conveyor device, but the present invention is not limited to this example. For example, the liquid removal device of the present invention is also applicable to a case where a sheet-like member is stationary, and a liquid removal device including a slit nozzle is relatively moved parallel to the sheet-like member by a nozzle movement mechanism.

REFERENCE SIGNS LIST

1 liquid removal device
10 slit nozzle
20 air supply pipe
30 gap measurement device
40 gap adjustment mechanism
41 drive section
51, 53, 55 support member
102 nozzle front face
104 nozzle back face
110 gas flow channel
112, 216 jetting port
210 nozzle main body
212 nozzle main body front face
214 nozzle main body back face
220 back face member
S steel sheet

The invention claimed is:

1. A liquid removal device that removes liquid attached to a surface of a steel sheet, the liquid removal device comprising:

a slit nozzle that jets gas from a jetting port to the surface of the steel sheet; and a gap measurement device that measures a gap between the jetting port of the slit nozzle and the steel sheet, wherein the slit nozzle is installed so as to jet gas from a downstream side toward an upstream side in a. movement direction of the steel sheet that moves relatively to the slit nozzle, the movement direction of the steel sheet is a horizontal direction, and the slit nozzle satisfies the following relational formulas:

$$P_n \geq 2.0\times10^{10}(h/d)^{0.6}\left(\frac{1}{1+\exp(\beta+\theta-58)}+1\right)^4 L^{-7}, \quad \text{[Math. 1]}$$

$$\beta+\theta \geq 60°,\ 100\ \text{mm} \geq L \geq 20\ \text{mm},$$

where gas pressure inside the slit nozzle is defined as nozzle pressure $P_n$ [KPa], an angle formed by a direction perpendicular to the surface of the steel sheet and a jet direction of the gas is defined as a jet angle θ [°], an angled formed by the jet direction of the gas and a nozzle back face that is a face disposed from the jetting port of the slit nozzle toward the downstream side in the movement direction is defined as a back face inclination angle β[°], a length of the nozzle back face in the movement direction is defined as L [mm], the gap is defined as h [mm], and a slit width of the slit nozzle is defined as d [mm].

2. The liquid removal device according to claim 1, wherein the gap is adjusted to 20 mm or less on the basis of a measurement result of the gap measurement device.

3. The liquid removal device according to claim 2, wherein the gap is adjusted by changing a position of the slit nozzle.

4. The liquid removal device according to claim 2, wherein the steel sheet is moved in the movement direction by a table roll that conveys the steel sheet, and the gap is adjusted by changing a position of the table roll on which the steel sheet is placed.

5. The liquid removal device according to claim 2, wherein the gap measurement device measures the gap at each of measurement positions near both ends of the jetting port of the slit nozzle in a longitudinal direction, and the gap is adjusted at each of the measurement positions to 20 mm or less.

6. The liquid removal device according to claim 5, wherein the gap measurement device is a laser rangefinder.

7. The liquid removal device according to claim 1, wherein the slit nozzle is fixed, and the steel sheet moves relatively to the slit nozzle by being moved in the movement direction by a conveyor device.

8. The liquid removal device according to claim 7, wherein the conveyor device is a. table roll on which the steel sheet is placed.

9. The liquid removal device according to claim 7, wherein the conveyor device is a coiling/uncoiling device including a pay-off reel that uncoils the steel sheet wound in a coil form, and a tension reel that coils, into a coil form, the steel sheet from which the liquid has been removed.

10. The liquid removal device according to claim 1, wherein the steel sheet is stationary, and the slit nozzle is moved relatively to the steel sheet.

11. The liquid removal device according to claim 1, wherein the slit nozzle includes a nozzle main body including the jetting port, and a gas flow channel that guides, to the jetting port, the gas that is externally supplied, and a back face member having the nozzle back face provided to extend from the jetting port of the nozzle main body toward the downstream side in the movement direction of the steel sheet, and the nozzle back face is a counter face of the back face member that faces the surface of the steel sheet.

12. A liquid removal method that removes liquid attached to the surface of the steel sheet by using the liquid removal device according to claim 1, the liquid removal method comprising:

a measurement step of measuring, by the gap measurement device, a gap between the jetting port of the slit nozzle and the steel sheet;

a gap adjustment step of adjusting the gap to 20 mm or less by changing a position of at least one of the slit nozzle and the steel sheet on the basis of the measured gap; and a liquid removal step of removing the liquid attached to the surface of the steel sheet by jetting gas from the slit nozzle to the surface of the steel sheet while relatively moving the slit nozzle and the steel sheet.

13. The liquid removal method according to claim 12, wherein the gap is readjusted by executing the measurement step and the gap adjustment step each time a sheet thickness of the steel sheet changes.

* * * * *